United States Patent [19]

Johnson

[11] Patent Number: 4,586,412

[45] Date of Patent: May 6, 1986

[54] ROTARY TIN-TIE CUTTING MECHANISM FOR A PACKAGING MACHINE

[75] Inventor: Gerald R. Johnson, Deronda, Wis.

[73] Assignee: Doboy Packaging Machinery, Inc., New Richmond, Wis.

[21] Appl. No.: 639,025

[22] Filed: Aug. 9, 1984

[51] Int. Cl.[4] ..... B26B 51/04

[52] U.S. Cl. ..... 83/205; 53/71; 83/210; 83/298; 83/335; 83/369

[58] Field of Search ..... 83/70, 203, 205, 209, 83/210, 212, 283, 369, 298, 339, 331, 335; 53/67, 71; 156/355, 521

[56] References Cited

U.S. PATENT DOCUMENTS

| | | | |
|---|---|---|---|
| 2,754,908 | 7/1956 | Proud | 83/364 |
| 3,803,962 | 4/1974 | Koslow | 83/335 |
| 3,890,190 | 6/1975 | Eburn, Jr. | 156/521 |
| 4,082,023 | 4/1978 | Hertsius et al. | 83/369 |
| 4,217,744 | 8/1980 | Mizutani | 53/71 |
| 4,362,076 | 12/1982 | Sasaki et al. | 83/283 |
| 4,398,990 | 8/1983 | Kühni et al. | 156/521 |
| 4,411,721 | 10/1983 | Wishart | 156/521 |

*Primary Examiner*—Frank T. Yost
*Assistant Examiner*—Hien H. Phan
*Attorney, Agent, or Firm*—Orrin M. Haugen; Thomas J. Nikolai

[57] ABSTRACT

In a packaging machine of the type in which a "tin-tie" strip is affixed to a bag to allow repeated reclosures of the bag, a machine for cutting a continuous strip of tin-tie material into predetermined lengths and feeding the cut lengths into a bonding station where they are adhesively bonded to the bag proximate its top opening. The machine comprises a frame supporting a pair of electromagnetic clutches, one for selectively coupling a continuously driven shaft to an output shaft to which a tin-tie strip feedwheel is attached and the other for selectively coupling a continuously driven shaft to an output shaft to which a rotary cutting head is secured. Passage of a bag past a sensor triggers the two clutches which function to withdraw a predetermined length of tin-tie material from a supply reel and to sever the strip while feeding the cut length to the bonding station at the same speed as the bag is moving.

4 Claims, 6 Drawing Figures

Fig. 5
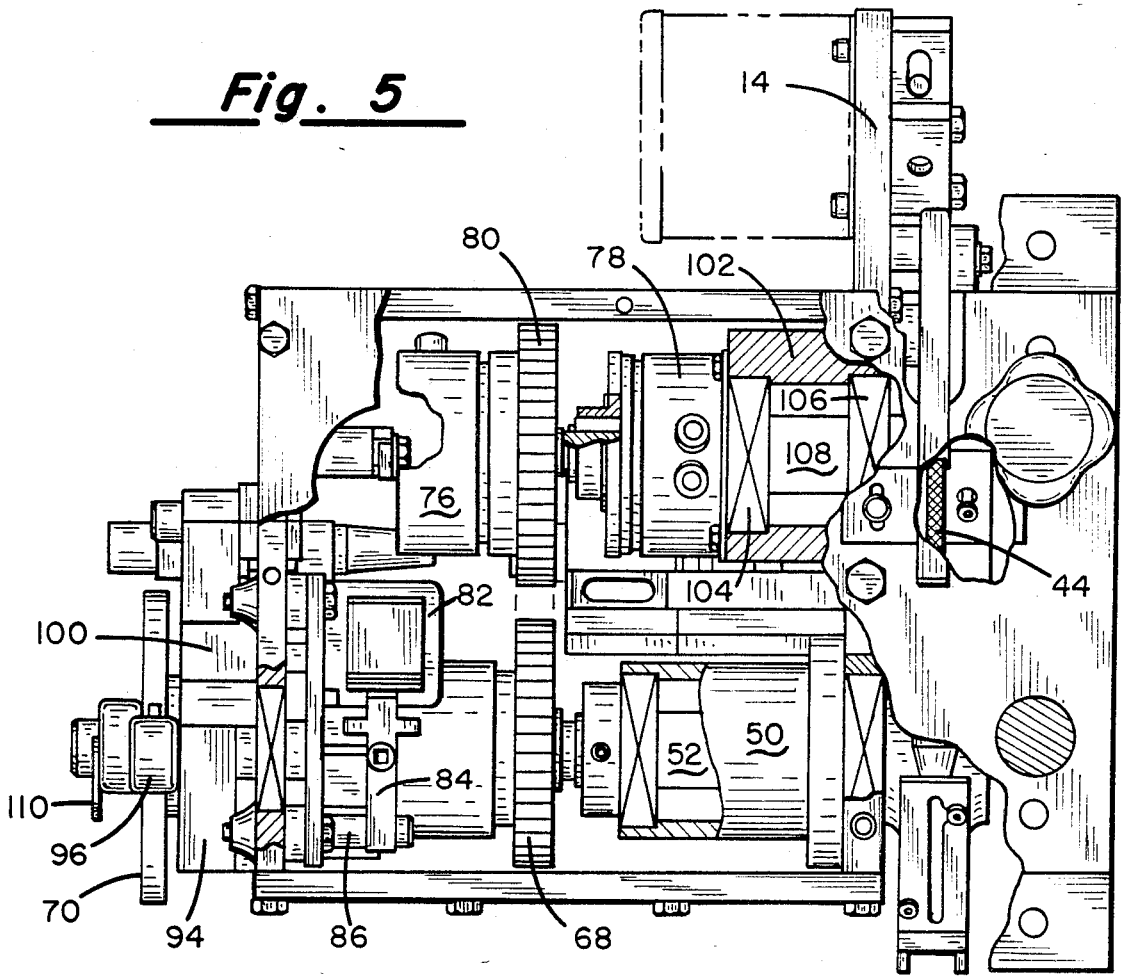
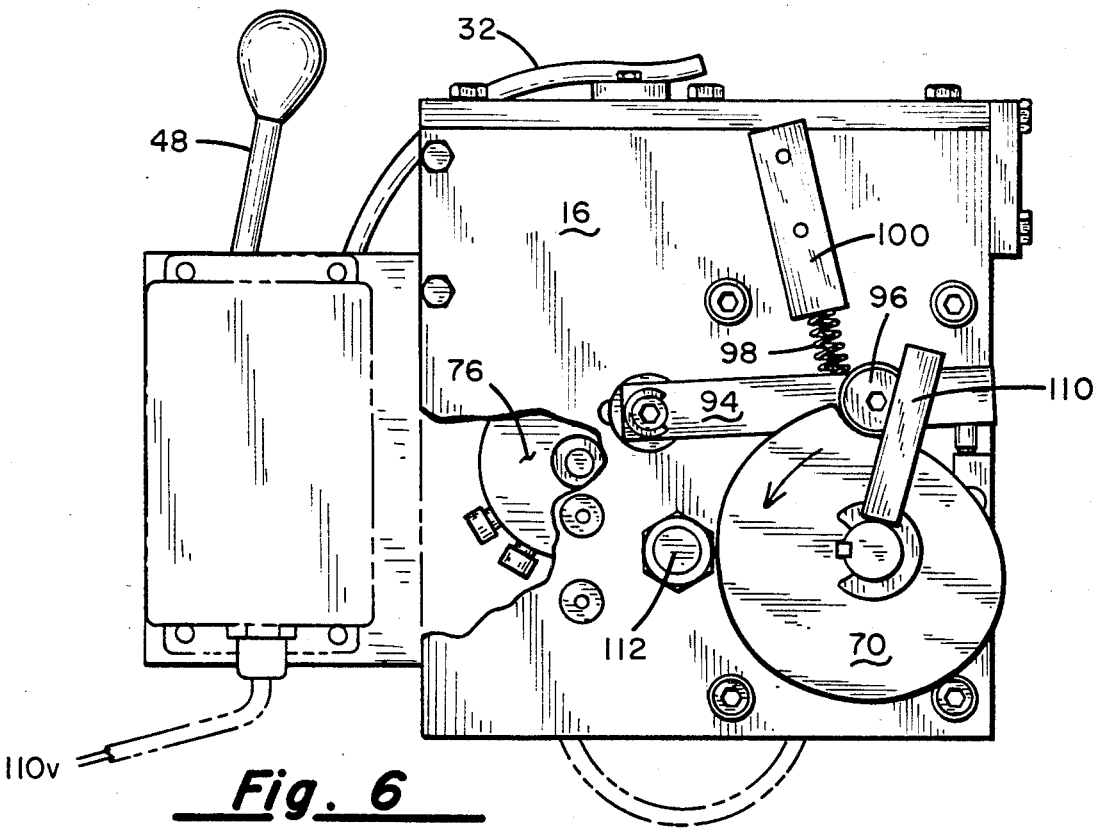
Fig. 6

ROTARY TIN-TIE CUTTING MECHANISM FOR A PACKAGING MACHINE

BACKGROUND OF THE INVENTION

I. Field of the Invention

This invention relates generally to high-speed packaging machinery and, more particularly, to an improved mechanism for use in a machine for making reclosable bags, the mechanism functioning to cut tin-tie strip material to desired lengths and to feed same to a bonding station where the cut length of tin-tie material is bonded to the bag as it passes through the high-speed packaging machine.

II. Discussion of the Prior Art

In a co-pending patent application of James H. Klemesrud, Ser. No. 451,354, filed Dec. 30, 1982, (now U.S. Pat. No. 4,490,960) and assigned to applicant's assignee, there is described a high-speed packaging machine in which a preformed bag, filled with product, is transported along a path and in which a tin-tie strip is appended across the top of the bag, with the bag then being folded and the tin-tie strips being bent to effectively seal the bag. The cutting of the tin-tie ribbon or strip is accomplished by means of a scissors-like shear actuated by a power cylinder. The power cylinder is, itself, controlled by a photoelectric eye, such that the scissors mechanism operates in synchronism with bag passage.

The tin tie cut-off machanism of the Klemesrud application is suitable for many applications. However, where higher package feed rates are desired, this reciprocating scissors mechanism creates a bottleneck. Specifically, the feed mechanism and the shear arrangement of the Klemesrud application necessarily must operate on an intermittent basis so that the scissor blade performs its cutting function with the bag and tin-tie strip at rest. This is because the scissor blade moves through an arc which is transverse to the direction of motion of the bag.

The tin-tie cut-off mechanism of the present invention obviates this problem and permits the tin-tie ribbon to be severed without having to interrupt the travel of the bag along its conveyor. Thus, the mechanism of the present invention allows a significant increase in the "packages per minute" throughput of the bag sealing machine.

SUMMARY OF THE INVENTION

In accordance with the present invention, the scissors-type cutting mechanism of the prior art is replaced with a rotary cutter which is used to sever a predetermined length of tin-tie ribbon from a supply reel thereof and to feed the cut segment along with the bag to which it is to be affixed into a bonding station at the same continuous speed. The rotary cutter assembly includes first and second continuously driven shafts which are adapted to be coupled through electromagnetically actuated clutches to a tin-tie feedwheel and to the rotary cutter head. Upon detection of the leading and trailing edges of a bag at a predetermined point along the conveyor line, the clutches are actuated to advance a length of tin-tie material downstream from the cutting head while, at the same time, driving the rotary cutter head through its path of travel such that the blade reaches and severs the strip only upon passage of the predetermined length which is to be affixed to the bag. Once the output shafts associated with the feed wheel and the cutter head reach their home positions, the clutch mechanisms are deactivated until such time as another bag is sensed passing down the conveyor line. Because of the use of a clutch-driven rotary cutting head, it is unnecessary to interrupt the flow of bags along the conveyor line as has been the case with the prior art scissors-type cutting mechanism.

OBJECTS

It is accordingly a principal object of the present invention to provide a new and improved apparatus for cutting and feeding tin-tie strips in a high-speed bag sealing machine.

Another object of the invention is to provide an improved cutting mechanism for tin-tie strips for use in a high-speed bag sealing machine which does not require the bag travel to be interrupted during the cutting sequence.

A still further object of the invention is to provide an improved rotary cutter for tin-tie material which may be incorporated into a high-speed bag sealing machine wherein the feeding of the tin-tie strip and the severing thereof are synchronized with the movement of bags through the machine.

These and other objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE DRAWINGS

FIG. 5 is a top plan view with a portion of the frame broken away and with certain parts cross-section to reveal the internal construction; and FIG. 6 is a right side elevation of the embodiment of FIG. 2.

DESCRIPTION OF THE PREFERRED EMBODIMENT

Figure 1:
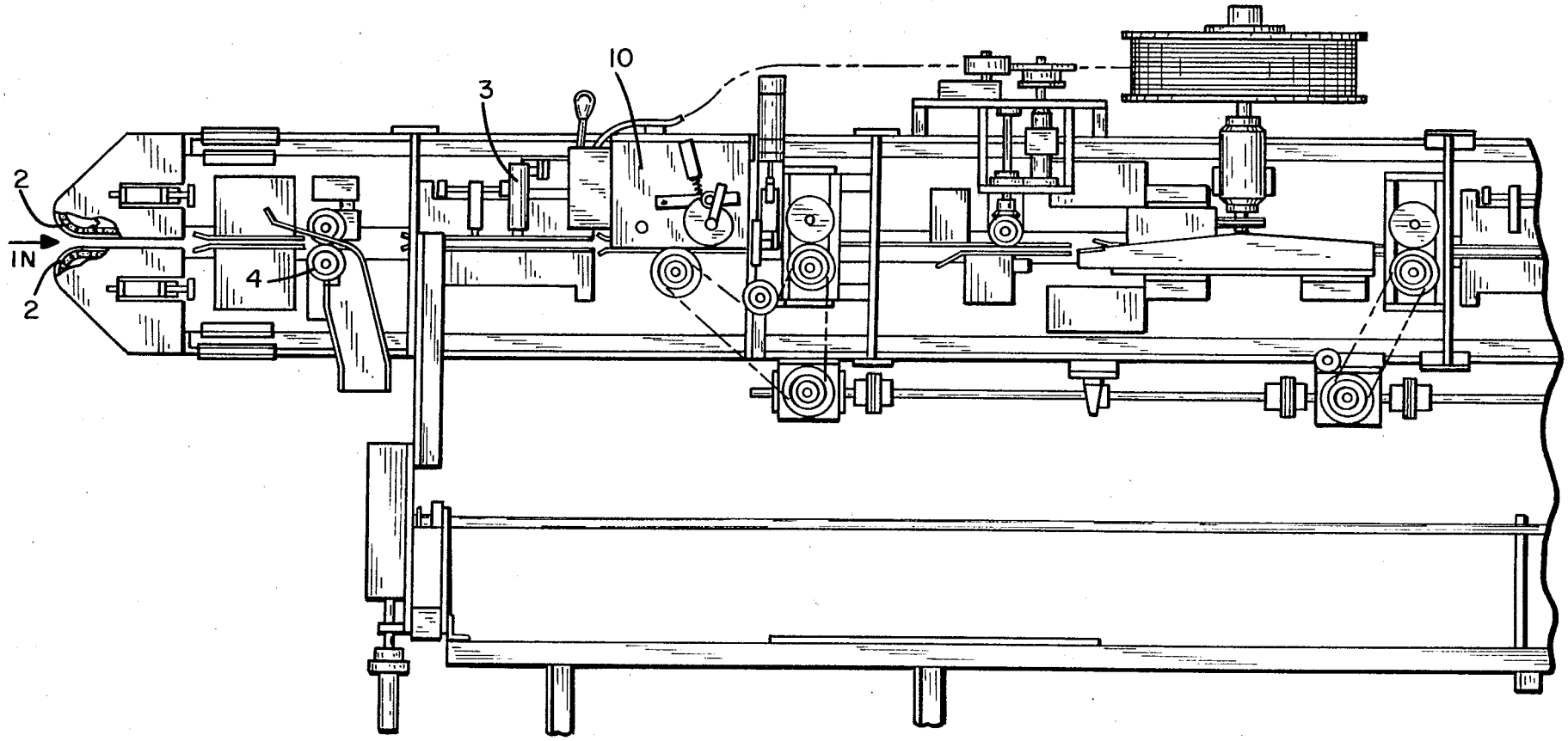
FIG. 1 is a plan view of a bag sealing machine in which the present invention finds use.

Certain terminology will be used in the following description for convenience in reference only and should not be construed as limiting. The words "upwardly", "downwardly", "rightwardly" and "leftwardly" will refer to directions in the drawings to which reference is made. The words "inwardly" and "outwardly" will refer to directions toward and away from, respectively, the geometric center of the device and associated parts thereof. This terminology is intended to include the words specifically mentioned above, derivatives thereof as well as words of similar import.

In order for the reader to appreciate the environment in which the present invention finds application, FIG. 1 comprises a portion of the reclosable bag sealing mechanism described in the aforereferenced Klemesrud patent application, except that the scissors-type tin-tie strip cutting mechanism thereof is shown as having been replaced by the rotary cutter 10 of the present invention. As is described in that earlier application, filled bags are initially introduced into the machine between an opposed pair of guide housings 1—1 where the neck of the bag is engaged between a pair of flat carrier chains 2 which run substantially the entire length of the machine and which are driven in a continuous fashion by a motor (not shown). As is further described in the aforereferenced Klemesrud application, the paper bags traversing the machine are trimmed by a pair of rotary trimming disks 4 which clip off the top of each bag. After passing through the trimmer station, a pneumatically operated glue applicator 3 is used to apply a bead of glue horizontally across the face of one side of each bag.

Following the application of the bead of glue to the bag, it moves down the line to the rotary tin-tie device of the present invention. It is, of course, the purpose of the present invention to produce a tin-tie strip of a predetermined length which is greater than the length of the bag neck and to feed that cut strip in precise synchronism with the bag between opposed compression rollers (not shown) which serve to tightly press the tin-tie strip against the adhesive bead with opposite ends of the cut tin-tie strip extending beyond the edges of the bag's neck.

Having described the relevant portions of the bag sealing machine and the general orientation of the device of the present invention therein, consideration will now be given to the constructional features of the device itself. As can be seen from the perspective view of FIG. 2, the rotary tin-tie cutter is indicated generally by numeral 10 and includes a frame consisting of a left side plate 12, a right side plate 14 and a cross plate 16 extending between the two side plates and holding them in a generally parallel and spaced-apart relationship. Added rigidity and strength is afforded by the steel cross-members 18 and 20. Bolted or otherwise affixed to the exterior surface of the side plate 14 is a tin-tie guide track assembly 22. Guide track cover plates 24 and 26 are affixed to the guide track assembly 22 and are spaced relative to one another to form a gap. Aligned with this gap is a roller 28 which is pivoted for rotation axis 30. A continuous length of tin-tie material is fed from a reel (not shown) and through a somewhat flattened, curved guide tube 32 so as to exit therefrom proximate the entrance 34 of the guide track assembly 22.

Pivotally attached by a shoulder bolt 35 to the outer surface of the side plate 14 is a lever arm 36 having a pinch roller 38 journaled for rotation proximate the innermost end thereof. A compression spring 40, which extends between the lever arm 36 and a spring abutment 42, normally urges the roller 38 upward in a clockwise direction when viewed as in FIG. 2. Thus, the pinch wheel 38 normally presses the tin-tie strip against the knurled peripheral surface 44 of a tin-tie strip drive roller 46. A handle 48 is attached to the lever arm 36 and, when pushed counterclockwise, moves the pinch roller 38 away from the knurled wheel 46 to facilitate initial threading of the tin-tie material through the guideway 22.

Bolted to the inside surface of the side plate 14 is a bearing housing 50 in which is journaled a shaft 52 (FIG. 5). This shaft extends through a hole in the side plate and affixed to its outer end is a rotary cutting head 54. The cutting head comprises a cylindrical block 56 having a recess 58 extending radially inward, and contained within this recess is a sharpened knife member 60.

The shaft 52 extends from a clutch mechanism 62 which is fixedly attached to the inside surface of the side plate 12 by means of a clutch mounting plate 64 and a bearing plate 66. Clutch 62 is preferably an intermittant drive clutch of the type manufactured by the The Hilliard Corporation of Elmira, N.Y., but limitation thereto is not intended. A spur gear 68 is concentrically mounted on the shaft 54 and is secured to the outer rotatable housing of the clutch mechanism 62. Secured to the opposite end of the clutch shaft 54 is a cam plate 70, the purpose of which will be described later on.

Figure 2:
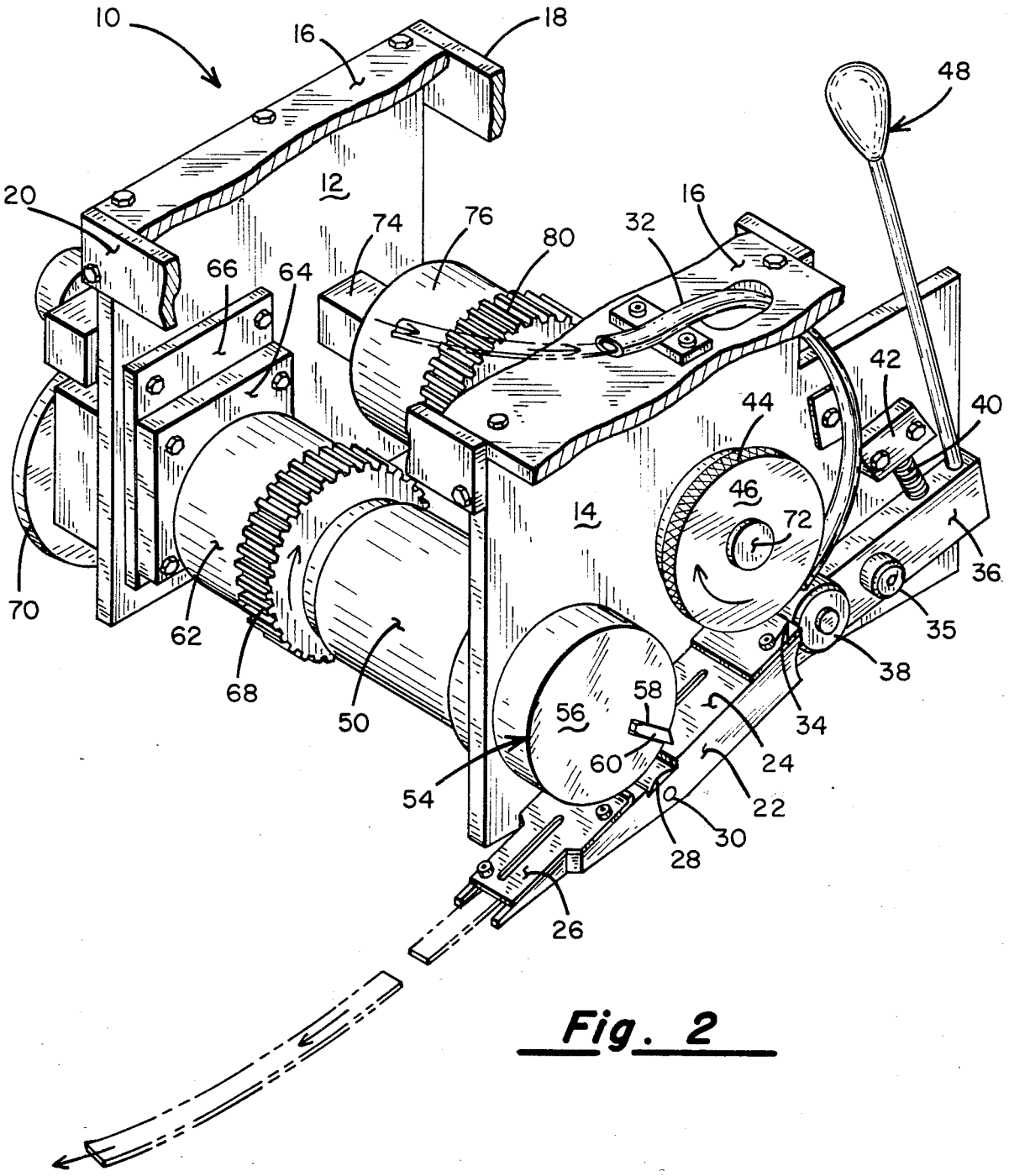
FIG. 2 is a perspective view of the improved rotary tin-tie cutter of the present invention as embodied in the bag sealing machine of FIG. 1.

To render various parts more visible in the perspective view of FIG. 2, the solenoid actuator for the clutch 62 has been left off. This structure will, however, be described in greater detail when the views of FIGS. 4 and 5 are considered.

The knurled drive roller 46 is secured to a shaft 72 which passes through a hole in the side plate 14, the shaft being suitably journaled in a manner to be described later on. This shaft is journaled at its leftmost end in a bearing block 74 and passes through a clutch 76 and an electromechanical brake 78 (FIG. 5). The clutch 76 is preferably a so-called Warner clutch manufactured and distributed by the Warner Electric Brake & Clutch Company of South Beloit, Ill., however, limitation to that particular clutch is not intended. Also affixed to the shaft 72 is a spur gear 80, which is intended to mesh with the same drive gear used to drive the spur gear 68. This drive gear is shown in phantom line representation in the lower portion of FIG. 3.

Figure 4:
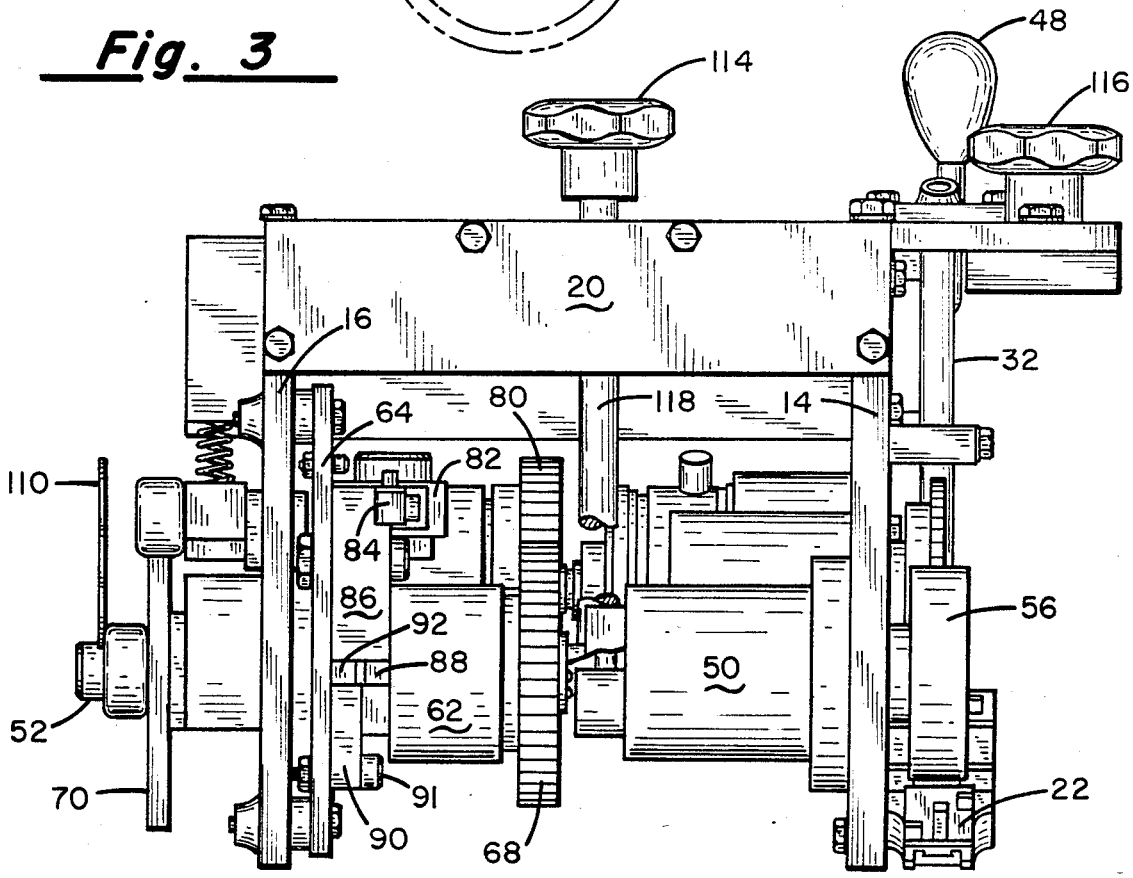
FIG. 4 is a front elevation of the preferred embodiment.

With reference to FIGS. 4 and 5, identified by numeral 82 is a solenoid having a reciprocally moving armature 84 pivotally secured at its forward end to the clutch latch plate 86, which is normally biased by a spring (not shown) so that its lower end (when viewed in FIG. 4) is urged inwardly against the outer surface of the rotatable clutch housing. As such, during the rotation of the clutch housing, the latch member 86 selectively coacts with a stop or boss 88 projecting outward from that housing.

A further latch 90 is pivotally secured by a shoulder bolt 91 to the clutch mounting plate 64 and it, too, is biased by a tension spring (not shown) so that its upper end rides against the rotating surface of the clutch housing and cooperates with a boss or stop 92 formed thereon to prevent shaft rotation in the counterclockwise direction when viewed as in FIG. 2.

Next, with reference to FIG. 6, pivotally secured to the outer surface of the side plate 16 is a pivot arm 94 on which a cam follower wheel 96 is journaled. A compression spring 98, extending between a spring abutment 100 and the arm 94, normally urges the cam follower wheel 96 against the edge or profile of the cam 70.

With continued reference to FIG. 5, additional features relating to the manner in which the knurled drive wheel 44 is journaled will be explained. Specifically, a cylindrical bearing housing 102 is bolted to the inside surface of the side plate 14 and contained within the housing 102 are ball bearing assemblies 104 and 106 in which a shaft 108 is journaled. The shaft, of course, passes through an opening in the side plate 14 and the knurled drive roller 44 is keyed thereto. The brake 78 surrounds the shaft 108 and, when energized, serves to lock the shaft 108 from rotation. The spur gear 80 is operatively coupled through the Warner clutch 76 to the shaft 108 when the clutch is appropriately energized by an electrical current. The clutch and brake, of course, operate on an alternative basis. When the clutch is engaged, the brake is off and vice-versa.

Attached to the cutting knife shaft 52 and rotatable therewith is a thin, metal wand 110 which is intended to cooperate with a magnetic proximity switch 112 which is mounted on the exterior surface of the side plate 16. As the wand 110 sweeps past the proximity switch 112, a signal is generated, the purpose of which will be set forth when the overall operation of the system of the present invention is explained.

Figure 3:
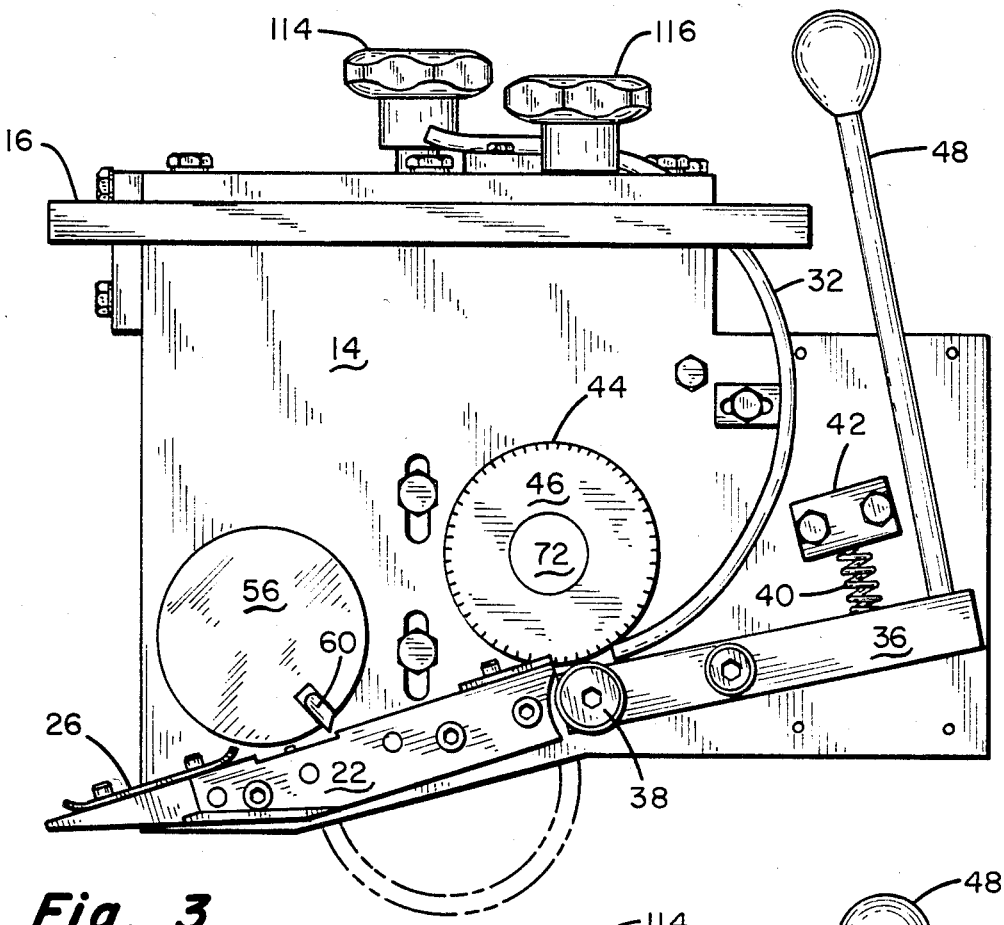
FIG. 3 is a right side view of the apparatus of FIG. 2.

With reference to FIGS. 2 and 3, the knobs 114 and 116 are used to facilitate the turning of threaded shafts as at 118 which are used to mechanically connect the rotary cutting assembly 10 to the high-speed packaging machine, the threaded shafts cooperating with suitable threaded bores on the machine for connecting and holding the assembly 10 in proper orientation with the outlet from the guide track 22 appropriately aligned with the path of travel of the bags along the conveyor chains 2—2 in FIG. 1.

Having described the overall mechanical construction of the present invention, consideration will next be given to its mode of operation.

OPERATION

As a filled bag to be sealed progresses down the line with its neck firmly gripped between the conveyor chains 2—2 (FIG. 1), its leading edge interrupts a beam of radiation directed to a photocell (not shown) and an electrical signal is generated which, through a conventional switching circuit, causes an energizing current to be applied to the Warner clutch/brake combination 76/78 to release the brake and engage the clutch. In that the spur gear 80 is being continuously driven, the energization of the clutch causes the shaft 108 to which the knurled wheel 46 is attached to be driven in a clockwise direction when viewed as in FIG. 2. In that the pinch roller 38 is squeezing the tin-tie strip against the knurled surface 44 of the drive wheels 46, the tin-tie strip will be drawn from its supply spool and fed through the tubular track 32 and through the guide track assembly 22. Once the trailing edge of the bag is sensed by the above-mentioned photosensor, the Hilliard clutch 62 is activated by virtue of a current being applied to the winding of the solenoid 82 which draws the armature 84 to the rear (FIG. 4). This, in turn, causes the latch 86 to pivot, releasing the boss 88, causing engagement of the shaft 52 with the rotation of the spur gear 68. Thus, the cutter head assembly 56 is driven and the blade 60 therein moves from the home position to a point where the knife tip engages both the tin-tie strip material and the roller anvil 28. This severs the tin-tie strip. The distance between the home position of the blade 60 and the cut position is set so as to cause a predetermined length of tin-tie strip to extend beyond the trailing edge of the bag. Once the cut has been made, the Hilliard clutch 62 continues to be engaged so as to cause the cutter head to rotate one full revolution to the point where the cutter blade is again at its home position. At this point, the boss 88 again engages the bottom of the latch 86 causing the release of the clutch whereby the shaft 52 and the cutter head 56 attached thereto is no longer driven.

It is found that the clutch exhibits an undesirable drag and can be damaged if the boss 88 is brought into engagement with the latch 86 before the boss 92 does. It is function of the cam 70 and its associated follower arrangement 94–100 to insure that this does not happen. Specifically, as the boss 88 on the exterior of the clutch member 62 closely approaches the bottom edge of the retracted latch 86, the fall in the cam profile is reached and the spring 98 forces the follower 96 against the cam profile forcing the cam to rotate slightly counterclockwise (FIG. 6), which has the effect of moving the stop 92 into abutment with the bottom of the latch 86 and completely releasing the clutch so that its rotatable housing 62 freewheels until such time as the solenoid 86 is again energized on a succeeding cycle.

It is the function of the proximity sensor 112 to control the length of tin-tie strip which will pass downstream from the cutting knife following the severing of the preceding length of tin-tie material. Thus, it is the proximity sensor and its associated metal wand 110 that determines the length of tin-tie material which will be located downstream from the leading edge of the next successive bag passing through the system. Specifically, the angular distance between the wand 110 and the proximity sensor element 112 (FIG. 6) defines that extension length in that the signal developed by the passage of the wand 110 past the proximity sensor 112 is used to control the off condition for the clutch 76 and the "on" condition for the brake 78, each of which is associated with the feed roller 46.

Those skilled in the art will recognize that the overall length of a cut tin-tie strip should equal the bag width plus the bendable lengths which are projecting beyond the leading and trailing edges of the bag. The bag width is sensed by the photocell (not shown), the trailing bendable length is determined by the distance between the home position of the knife blade 60 and the cutting point thereof while the leading bendable length is determined by the angular distance between the wand 110 and the associated proximity sensor 112. The angular position of wand 110 relative to the cutting knife 60 is adjustable so that the system can be readily changed to work with bags of differing dimensions.

It is important to note that because the knife 60 cuts through the tin-tie material on-the-fly and that the tin-tie strip and the bag are made to travel at the same speed, the overall throughput of the machine is improved over one using the prior art scissors-type cutter.

While there has been shown and described a preferred embodiment of the invention, various changes and modifications to the overall structure will occur to those skilled in the art. Hence, the scope of the invention is to be determined from the following claims.

What is claimed is:

1. In a bag sealing machine of the type including conveyor means for continuously transporting filled bags past a tin-tie strip bonding station, apparatus for supplying cut lengths of said tin-tie strips to said bonding station in synchronism with the arrival of the continuously moving filled bags, said apparatus comprising in combination:

(a) a frame;

(b) first and second shafts journaled for rotation in said frame;

(c) continuously rotating drive means operatively coupled to said conveyor means and driven at a speed proportional to the speed of said conveyor means;

(d) guide means secured to said frame for routing flexible strip material along a predetermined path terminating in a close parallel relation to the path of travel of said bags along said conveyor means;

(e) friction roller means disposed on said first shaft and positioned relative to said guide means selectively for engaging said strip material and moving said strip material along said guide means;

(f) a rotary cutter head attached to said second shaft and positioned relative to said guide means for periodically severing said strip material passing along said guide means;

(g) a first electrically actuated clutch for selectively coupling said continuously rotating drive means to said first shaft for driving said friction roller means independent of said rotary cutter head;

(h) a second electrically actuated clutch for selectively coupling said continuously rotating drive means to said second shaft for driving said rotary cutter head from a home position to a strip material severing position and back to said home position; and (i) means responsive to the presence of a bag at a given location along said conveyor means for applying control signals to said first and second electrically actuated clutches to continuously advance a length of said strip material through said guide means and to cut a predetermined length of said strip material from a supply source with the cut length of strip material being moved at the same relative velocity as the bag as the two enter said bonding station.

2. The apparatus as in claim 1 wherein said rotary cutting head comprises a right circular cylinder having at least one cutting blade projecting outwardly from the periphery thereof for engaging said strip material.

3. The apparatus as in claim 1 and further including means coupled to said second shaft for controlling the time of deactivation of said first electrically actuated clutch following the severing of said strip material by said cutting blade.

4. The apparatus as in claim 3 wherein said means for controlling the time of deactivation of said first clutch includes means for producing a control signal upon the passage of a predetermined point on said rotary cutter head past a stationary location on said frame.

* * * * *